US009412478B2

(12) United States Patent
Cianchi et al.

(10) Patent No.: US 9,412,478 B2
(45) Date of Patent: Aug. 9, 2016

(54) METHOD FOR REMOVING THE $^{137}$CS FROM POLLUTED EAF DUSTS

(71) Applicants: Aldo Cianchi, Mestre (IT); Sandro Degetto, Padua (IT)

(72) Inventors: Aldo Cianchi, Mestre (IT); Sandro Degetto, Padua (IT)

( * ) Notice: Subject to any disclaimer, the term of this patent is extended or adjusted under 35 U.S.C. 154(b) by 0 days.

(21) Appl. No.: 14/397,154

(22) PCT Filed: Apr. 18, 2013

(86) PCT No.: PCT/IB2013/053067
§ 371 (c)(1),
(2) Date: Oct. 24, 2014

(87) PCT Pub. No.: WO2013/160806
PCT Pub. Date: Oct. 31, 2013

(65) Prior Publication Data

US 2015/0148582 A1 May 28, 2015

(30) Foreign Application Priority Data

Apr. 27, 2012 (EP) ..... 12425082

(51) Int. Cl.

| | |
|---|---|
| ***G21F 9/14*** | (2006.01) |
| ***G21F 9/06*** | (2006.01) |
| ***G21F 9/30*** | (2006.01) |
| ***A62D 3/178*** | (2007.01) |
| ***A62D 3/37*** | (2007.01) |
| ***A62D 3/38*** | (2007.01) |
| ***G21F 9/32*** | (2006.01) |

(52) U.S. Cl.
CPC *G21F 9/06* (2013.01); *A62D 3/178* (2013.01); *A62D 3/37* (2013.01); *A62D 3/38* (2013.01); *G21F 9/30* (2013.01); *G21F 9/32* (2013.01)

(58) Field of Classification Search
CPC ..... G21F 9/14
USPC ..... 588/19
See application file for complete search history.

(56) References Cited

U.S. PATENT DOCUMENTS

| | | | |
|---|---|---|---|
| 5,570,469 | A | 10/1996 | Soderstrom |
| 5,614,077 | A | 3/1997 | Wittle |

FOREIGN PATENT DOCUMENTS

| | | | |
|---|---|---|---|
| DE | 3942027 | A1 | 6/1991 |
| EP | 0419777 | A1 | 4/1991 |

OTHER PUBLICATIONS

International Search Report from corresponding PCT application, dated Jul. 5, 2013.

*Primary Examiner* — Edward Johnson
(74) *Attorney, Agent, or Firm* — Hedman & Costigan, P.C.; James V. Costigan; Kathleen A. Costigan

(57) ABSTRACT

The present invention refers to a method and related plants for removing, by means of redox reactions, the $^{137}$Cs from polluted EAF dusts, with an initial average value of radioactivity concentration either higher or lower than 10,000 Bq/kg, the decontamination from the $^{137}$Cs initially present in the EAF dusts having a yield of 98%-100%; the present invention also refers to the use of chemical-physical destabilization agents, by means of redox reactions, for obtaining EAF dusts decontaminated from $^{137}$Cs.

17 Claims, 1 Drawing Sheet

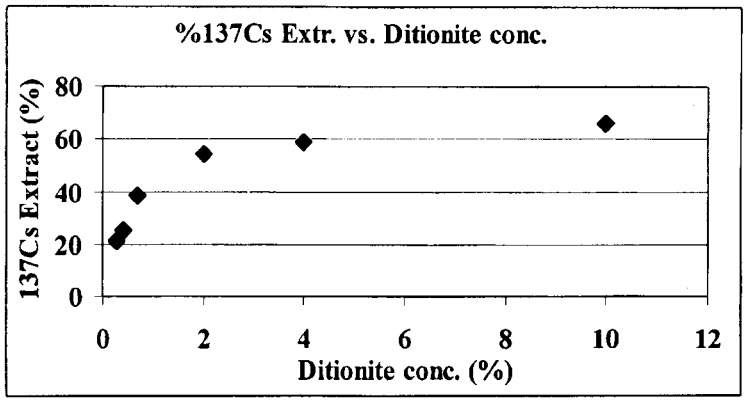
%137Cs Extr. vs. Ditionite conc.
137Cs Extract (%)
80
60
40
20
0
0
2
4
6
8
10
12
Ditionite conc. (%)

METHOD FOR REMOVING THE $^{137}$CS FROM POLLUTED EAF DUSTS

TECHNICAL FIELD

The present invention relates to a method for treating electric arc furnace (EAF) dusts.

In particular, the invention relates to a method for removing the $^{137}$Cs content from polluted EAF dusts.

Furthermore, the present invention relates to a plant for carrying out the method for removing the $^{137}$Cs content from polluted EAF dusts.

Furthermore, the present invention relates to the use of destabilisation chemical-physical agents, specifically oxidation-reduction or redox agents, for obtaining EAF dusts decontaminated from $^{137}$Cs.

KNOWN PRIOR ART

In the ferrous scrap based steel manufacturing industries, the accidental melting of radioactive sources in the melting furnaces represents an unfortunately recurring event, which has been involving several factories in Italy, Europe and worldwide over the last few years.

The continuous improvement in the control systems of ferrous materials entering plants has certainly decreased the number of such events; however, the different control phases, starting from the radiometric examination of incoming materials up to the final visual inspections, can not ensure that the scrap is totally free from foreign materials, in particular from radioactive sources.

When such unfortunate and unintentional events involve orphan sources of $^{137}$Cs, said radioactive element completely converts into the vapour state during the melting process (temperature of the melting furnace: 1,400° C.-1,700° C.) and then, upon cooling, it mixes with the dusts produced during said melting process; such dusts are not released to the outside environment thanks to suitable and efficient filtration systems.

The activity concentration present in such dusts depends on the characteristics of the molten source, whose activity can vary from a few MBq to hundreds GBq, but also on the dispersion and mixing of the polluted dusts with other non-radioactive dusts already present in the plant.

Therefore, the amount of polluted dusts can affect a total mass of several hundred tons, with activity concentrations varying from values lower than 380 Bq/kg, which is the threshold generally accepted for freely handling the dusts without radiological prescriptions, up to values exceeding 500,000 Bq/kg.

As a consequence, such radioactive dusts must be either isolated or subjected to suitable decontamination treatments so as to declassify them to non-radioactive dusts.

In the reference technical field the most common practice consists in segregating inside suitable storage sites; it is clear that this approach is not conclusive in terms of decontamination.

Furthermore, in the specific case of $^{137}$Cs, the decay half-life is more than 30 years; it follows that the segregation time to lower the radioactivity value below the unconditional release threshold (380 Bq/kg) is about 300 years.

The decontamination treatments studied so far are very few; the following are the only two publications found in which $^{137}$Cs is explicitly mentioned as a pollutant of EAF dusts: J. M. Arnal et al., "Management of Radioactive Ashes after a $^{137}$Cs Source Fusion Incident", 11th IRPA—International Radiation Protection Association International Congress, Madrid, Spain, May 23-28, 2004 and the U.S. Pat. No. 5,570,469 granted on Oct. 29, 1996 in the name of Soderstrom et al.

The treatment described in the aforementioned scientific publication in the name of J. M. Arnal et al. provides for leaching the polluted dusts with distilled water to which a non-radioactive salt of cesium (CsCl) is added to take advantage of the effect of isotopic exchange; the process is carried out in an acid medium (pH approximately 5) and at room temperature; the duration of the complete extraction process is approximately 24 hours; the yield of the treatment, after four stages of extraction, was 90%.

The treatment described in the aforementioned U.S. Patent provides a two-stage leaching process, both stages being carried out in an acid medium; in the second stage a non-radioactive salt of cesium is added (as in the previous case); the yield of the treatment is approximately 90%.

More precisely, the treatment described in the aforementioned U.S. Patent provides the solubilisation in two stages of the matrix, mainly consisting of Fe and Zn, to allow the recovery of the Cs brought in solution; the recovery of the Cs according to this invention takes place by ion exchange after the first leaching or by ion exchange after having carried out also a second leaching and after that Fe and Zn have been separated by precipitation from the solution.

It is highlighted that the process described in the above Soderstrom patent is a simple leaching process, which does not involve reductive and/or oxidative effects; specifically, according to this patent (see column 5, lines 31-50, and column 7, lines 3-6), the solubilisation of the matrix takes place thanks to the use of a strong acid, such as nitric acid, phosphoric acid, sulphuric acid and hydrochloric acid, the last two being the preferred ones.

As it is known from the field literature, the nitric acid is an excellent oxidiser while the hydrochloric acid is not deemed to be an oxidiser: nevertheless the latter is preferable to the former, that in fact is never used in the reported examples; on this basis, our opinion is that also the preferred choice of the sulphuric acid for the leaching according to the Soderstrom patent does not depend on its oxidant characteristics that, though being peculiar, are never mentioned in the patent.

Moreover the only element present in reduced phase in the EAF dusts is Fe, which is present in part as Fe(II); it is known, however, that the sulphuric acid is not able to oxidise the Fe(II) to Fe(III) and that this operation requires the presence of a suitable oxidant such as, for example, the permanganate ion.

The greater ease of use, in industrial terms, of the sulphuric acid appears to be given also by the subsequent neutralisation of the acid solution with CaO (see column 8, lines 33-36) that, by reacting with $H_2SO_4$, forms $CaSO_4$ almost insoluble; the formation of $CaSO_4$, besides facilitating the filtration as explained, also causes a strong decrease in the concentration of residual radioactive activity of $^{137}$Cs for simple mass increase (such a dilution in the concentration of residual radioactive activity would not be obtained, for example, with the acid hydrochloric owing to high solubility of calcium chloride).

The two aforesaid methods, at the moment the only known ones specific for the decontamination of $^{137}$Cs present in polluted EAF dusts, are not very convenient both in economic terms, for the complexity of the provided operations, and in terms of decontamination efficiency, that in both cases is expected to be 90%.

More promising than the methods described above appears to be the alkaline leaching under well-defined conditions (pH, temperature and contact times), as disclosed in the Italian Patent No. IT 1 358 799.

The method according to the aforesaid Italian Patent provides that the dusts contaminated with radioactive materials are subjected to washing with water under conditions of pH=9-13 (EAF dusts, in fact, contain oxides of Ca, K and Na that, in the presence of water, create a definitely basic medium), preferably under stirring and at a temperature of at least 60° C.; the yield of the treatment exceeds 95%.

The method according to the aforesaid Italian Patent has been successfully applied for totally decontaminating about 500 tons of dusts with $^{137}Cs$ activity concentration up to 25,000 Bq/kg, with an average value of about 5,000 Bq/kg.

Despite the above positive performance (effective decontamination yield >95%), said existing treatment would not be adequate to achieve decontamination from $^{137}Cs$ below 380 Bq/kg, 1,000 Bq/kg or 10,000 Bq/kg, with initial contamination average values of 7,600 Bq/kg, 20,000 Bq/kg or 200,000 Bq/kg respectively (assuming a precautionary yield of 95%).

We want to point out here that, from the radiological point of view, the value of 380 Bq/kg represents a level generally accepted for the unconditional release; the value of 1,000 Bq/kg is the level below which the material is considered "non-radioactive"; the value of 10,000 Bq/kg is the maximum acceptable level for controlled sites for hazardous wastes; as to levels greater than 10,000 Bq/kg, the materials must be confined in special radioactive storehouses.

Therefore, as already mentioned above and particularly in the presence of radioactive materials having a level greater than 10,000 Bq/kg, until the present time, to our knowledge, treatment technologies in alternative to the confinement (with the exception of the abovementioned case) have never been taken into account.

Therefore there still exists the need of identifying a method having better effectiveness, i.e. capable of removing the $^{137}Cs$ content below 380 Bq/kg starting from polluted EAF dusts with high average values (even exceeding 100,000 Bq/kg).

Moreover, the Inventors have observed that the method according to the aforesaid Italian Patent allows to decrease the content of $^{137}Cs$ present in the polluted dusts of about 20-25 times, this representing a substantially insuperable limit because the repetition of the leaching operations does not lead to a further decrease of the radioactive waste in the treated dusts; in other words, at least part of the $^{137}Cs$ appears to be under a chemical-physical form that can not be subjected to alkaline leaching.

One possible explanation for this occurrence could arise from the composition of the EAF dusts, whose chemical and mineralogical characteristics have been reported in several studies in the literature such as, for example, F. M. Martins et al., "Mineral phases of weathered and recent EAF dust", J. of Hazardous Material 154 (2008) 417-425; J. C. M. Machado et al., "Characterization Study of EAF Dust Phases", Materials Research 9 (2006) 41-45; C. Z. Rizescu et al., "Characterization of Steel Mill EAF dust", Advances in Waste Management—ISSN:1790-5095 ISBN:978-960-474-190-8.

A typical chemical composition of the EAF dusts comprises (% by weight): Fe 30-40%; Zn 10-15%; Ca 5-10%; Si 3-4%; Mg 1-2%; K 1-2%; Pb 1-2%, Mn 1-2%, Al 0.5-1%, Cu 0.2-0.5%; S 0.2-0.5%.

From the mineralogical point of view the presence of several species is known such as, for example, the Franklinite ($ZnFe_2O_4$), the Zincite (ZnO), the Magnetite ($Fe_3O_4$), the Laurionite (Pb(OH)Cl), thereby justifying the hypothesis that at least part of the $^{137}Cs$ can be present either as Cs-ferrite or as ($K^+$, $Cs^+$)-β-ferrite [see: Shigero Ito et al., Solid State Ionics 72(1994)300], these forms being stable under alkaline conditions.

On the other hand the magnetite, and other ferrites, are well known to be able to capture the cesium [see for example: Tao Yang et al., Surface Science 603(2009)78]; the subsequent elution of cesium absorbed on the magnetite and other ferrites could be done by acidification, but bearing in mind the simultaneous solubilisation of other species present and sensitive to the acid medium.

Since the above-mentioned method of the alkaline leaching according to the Italian Patent No. 1 358 799 is limited in terms of removal efficiency in the decontamination treatments, especially for usefully treating dusts polluted with a higher average content of $^{137}Cs$, it could be considered to carry out an acid leaching after the alkaline leaching, which could be useful, in principle, to attack the ferrites; however, this would involve a significant dissolution of the iron oxides also present (specifically, $Fe_2O_3$) that would take place much more easily than the attack of the same ferrites, creating a situation completely inconvenient for the subsequent separation of the $^{137}Cs$.

Therefore there still exists the need of identifying a method avoiding the solubilisation of the iron oxides and allowing a more specific attack of the $^{137}Cs$ present in the polluted EAF dusts.

Finally, there exists a felt need of identifying a method also involving a decrease in the consumption of materials used in the decontamination treatment.

There exists also a felt need of providing a plant for carrying out the method suitable to remove the $^{137}Cs$ from polluted EAF dusts and intended to achieve the objects described above.

In particular the European Patent application no. EP 0 419 777 A1 filed on Jul. 2, 1990 in the name of Rockwell International Corporation is known, in which a plant for treating nuclear reactors fuel is described; specifically said plant operates at 400° C. when the fuel is oxidised with $O_2$ and at 600° C. when the fuel is reduced with $H_2$: these operations pulverise the fuel that was previously in the form of pellets (see column 2, lines 11-25) in order to prepare it for the subsequent electrolytic reduction, through which the uranium is reduced to metal in a system of molten fluorides (see column 2, lines 46-51).

The plant described in the aforementioned application specifically aims to recover $UO_2$ fuel without fission products (among these, the radioactive cesium), because they interfere with the fission reaction, but it does not allow the removal of cesium; in fact, the separation of Cs, during the initial oxidation and reduction stages mentioned above, occurs in an inadequate degree (40-60%) for the purposes of the fuel regeneration and it is mainly obtained during the subsequent electrolytic separation of uranium in molten salts.

The reason for such insufficient separation possibly resides in the fact that the plant according to the abovementioned application operates at limited temperatures, while it is still unmet the need of a plant, specifically of a pyro-metallurgical plant, able to operate at temperatures such as to permit the complete separation of cesium.

OBJECTS AND SUMMARY OF THE INVENTION

It is therefore an object of the present invention to provide a method for overcoming the drawbacks of the prior technical solutions, both in terms of materials consumption and in terms of decontamination effectiveness.

In particular, it is an object of the present invention to provide a method for removing the $^{137}Cs$ content below 380 Bq/kg starting from polluted EAF dusts with high average values (even exceeding 100,000 Bq/kg).

It is also an object of the present invention to provide a method overcoming the limits existing at the moment in terms of removal effectiveness of the $^{137}Cs$ content present in the polluted dusts.

It is also an object of the present invention to provide a method avoiding the solubilisation of the iron oxides during the decontamination treatment of $^{137}Cs$ polluted EAF dusts.

It is, finally, an object of the present invention to provide a method also involving a decrease in the consumption of materials used in the decontamination treatment.

Furthermore, the present invention provides a plant for carrying out the method for removing the $^{137}Cs$ from polluted EAF dusts.

Furthermore, the present invention provides the use of destabilisation chemical-physical agents, specifically oxidation-reduction or redox agents, for obtaining EAF dusts decontaminated from $^{137}Cs$; these chemical-physical agents essentially cause a variation of the oxidation state of some components of the matrix, which can be realised both in the hydro-metallurgical field and in the pyro-metallurgical field.

These and other objects of the present invention are achieved by means of the method comprising the features claimed in the annexed claims, which form integral part of the present description.

BRIEF DESCRIPTION OF THE DRAWING

FIG. 1 is a graphical representation of the effect of the concentration of dithionite on the amount of $^{137}Cs$ that is extracted from suspensions of polluted dusts.

Starting from the Inventors' observation of the fact that, as previously described in detail, $^{137}Cs$ is present in the polluted dusts, at least in part, under a chemical-physical form that can not be subjected to alkaline leaching, the method according to the present invention aims to facilitate the cesium release by destabilising the absorption system, for example by carrying out a chemical reduction under the same alkaline conditions.

The choice of the alkaline conditions, and more precisely the implementation of a method in a single stage in an alkaline medium, allows to leave substantially unaltered, i.e. to not dissolve, the ferrous matrix in both the provided attack modes, reductive or oxidative; as a consequence of the reductive or oxidative treatment, the stability of the complexes containing the radioactive cesium is destroyed—in other words, a destabilisation is therefore realised—resulting in the release of cesium.

It is worthy to explain here that, in particular, the method according to the present invention does not require the use of sulphuric acid that, since is a strong acid, actually dissolves the matrix itself contrary to what is sought with the present invention.

The Inventors believe that also the electrochemical reduction of the iron oxides, in an alkaline medium, falls within the wider scope of the reduction reactions.

While the invention is susceptible of various modifications and alternative implementations, some embodiments thereof will be described below in detail, in particular by means of illustrative examples.

It should be understood, however, that there is no intention to limit the present invention to the disclosed specific embodiments but, on the contrary, the invention intends to cover all the modifications, alternative and equivalent implementations falling within the scope of the invention as defined in the attached claims.

In the following description, therefore, the use of "e.g.," "etc.," and "or" denotes non-exclusive alternatives without limitation unless otherwise noted.

The use of "including" means "including, but not limited to," unless otherwise noted.

In the following description, moreover, the term "polluted EAF dusts" denotes dusts collected downstream the melting furnace, after the cooling step, inside the filtration system or in the dusts storage tank.

DETAILED DESCRIPTION OF THE INVENTION

The method for removing the $^{137}Cs$ from polluted EAF dusts according to the present invention comprises the following steps:

i) providing an amount of EAF dusts polluted with 137Cs, even with an initial average value >10,000 Bq/kg;

ii) subjecting the dusts to a chemical-physical destabilisation reaction, specifically to an oxidation-reduction or redox reaction; and iii) following the chemical-physical destabilisation reaction, specifically the oxidation-reduction or redox reaction, obtaining the release of cesium.

For clarity's sake, it is emphasised that the method according to the present invention does not provide two different reactions in steps ii) and iii); the release of cesium according to step iii) is the result of the chemical-physical destabilisation reaction by oxidation-reduction according to step ii) and it is not an autonomous step temporally subsequent to said destabilisation reaction.

At this point we want to specify that the EAF dusts polluted with $^{137}Cs$ treatable by the method according to the present invention may have any value of the initial radioactivity concentration, although said method is mainly directed to the treatment of dusts having an initial average value also >10,000 Bq/kg as indicated above; the method according to the present invention works independently of the initial concentration and the value of 10,000 Bq/kg has, at the present time, a reference table value since it represents the limit beyond which the regulations in force require expensive containment systems for the polluted dusts.

Optionally, after the step referred to in point i), the polluted EAF dusts can be subjected to a pre-treatment substantially consisting in an alkaline leaching with water.

As mentioned above, the main difficulty to be overcome, for which the Inventors have surprisingly found the present technical solution, is represented by the absorption of cesium on magnetite and other ferrites.

To this end, i.e. to solve the technical problem of the absorption of cesium on magnetite and other ferrites, the polluted EAF dusts are subjected to a chemical-physical destabilisation reaction.

The chemical-physical destabilisation (for example of the magnetite) can occur either by reduction or by oxidation of the polluted EAF dusts; the Inventors believe that also the electrochemical reduction of the iron oxides, in an alkaline medium, falls within the wider field of the reduction reactions.

In turn, the chemical-physical destabilisation can occur both in the hydro-metallurgical field and in the pyro-metallurgical field.

Finally it is also possible to combine the chemical-physical destabilisation by oxidation with that by reduction, and even suitably to combine the operation fields.

To make clear and unambiguous the meaning of the chemical-physical destabilisation reaction of the polluted EAF dusts according to the present invention, we must start from the characterisation of said EAF dusts that, generically, are a mixture comprising simple and complex oxides.

As partially anticipated in the discussion of the prior art, an illustrative chemical composition of the EAF dusts comprises (% by weight; components present as traces excluded): Fe: 25-50; CaO: 4-15; MgO: 1-5; $Al_2O_3$: 0.3-0.7; $SiO_2$: 1.5-5; $P_2O_5$: 0.2-0.6; MnO: 2.5-5.5; $Cr_2O_3$: 0.2-1; $Na_2O$: 1.5-1.9; $K_2O$: 1.2-1.5; Zn: 10-35; Pb: 0.8-6; Cl: 1.5-4, S: 0.5-1, the main species present in said EAF dusts, however, are always the same: $ZnO.Fe_2O_3$; $FeO.Fe_2O_3$; $MgO.Fe_2O_3$; $FeO.Cr_2O_3$; $Mn_3O_4$; MgO; $SiO_2$; $Ca_{0.15}Fe_{2.85}O_4$ and ZnO, as evidenced by field references such as, for example: Materials Research, Vol. 9, No. 1 (2006), 41-45, Janaina Gonçalves da Silva Maria Machado et al.; Tr. J. of Engineering and Environmental Science, Vol. 23 (1999), 199-207, H. Mordogan, T. Cicek, A. Isik; Ironmaking & Steelmaking, Vol. 35, No. 4 (2008), 315-320, da Silva Mr. Conserva et al., Journal of Hazardous Materials, Vol. 179 (2010), 1-7, P. Oustodakis et al.

The EAF dusts, since they are a heterogeneous mixture of oxides, when treated with acids are solubilised and form the salts corresponding to the acids employed.

To solubilise the EAF dusts many acids can be used, including the sulphuric acid that, as it will be seen below, does not involve oxidation phenomena.

If we assume, for simplicity and by way of explicative example only, that the EAF dusts are formed of the sole iron oxides, therein iron (Fe) is present with different degrees of oxidation (+2 and +3); the acid leaching of the iron oxides having oxidation states II or III forms, respectively, ferrous salts or ferric salts according to the reactions:

$$FeO+2H^+ \Rightarrow Fe^{2+}+H_2O$$

$$Fe_2O_3+6H^+ \Rightarrow 2Fe^{3+}+3H_2O$$

Therefore, the leaching acid attack carries out the above solubilisation action, without performing any oxidation reaction.

When operating in an acid medium, for example in the presence of sulphuric acid, to obtain the oxidation of Fe(II) is necessary to use a suitable oxidising agent, such as the ion permanganate, according to the following reaction:

$$5Fe^{2+}+MnO_4^-+8H^+ \Rightarrow 5Fe^{3+}+4H_2O+Mn^{2+}$$

wherein the permanganate ion oxidises the Fe(II) to Fe(III), while the manganese is reduced and passes from the state (VII) to state (II); the oxidation state of the sulphur in the $SO_4^{2-}$ ion, however, remains unchanged, as it does not take part in the reaction.

Similarly, when operating in an alkaline medium, to obtain the oxidation of Fe(II) is necessary to use a suitable oxidising agent, such as the permanganate ion, according to the following reaction:

$$3Fe^{2+}+MnO_4^-+2H_2O \Rightarrow 3Fe^{3+}+MnO^{2+}4OH-$$

wherein the manganese is reduced and passes from the state (VII) to state (IV).

For completeness, in a strong alkaline medium the following reaction occurs:

$$MnO_4^-+e^- \rightarrow MnO_4^{2-}.$$

Some preferred embodiments of the invention will be illustrated in detail hereinafter; in particular, the invention will be now better described with reference to the following examples.

As it will become evident from the examples below, the chemical-physical destabilisation reactions by redox occur in an alkaline medium, i.e. in the condition in which, as previously noted, the $^{137}Cs$ is present in the polluted dusts, at least in part, in a chemical-physical form not susceptible of alkaline leaching.

Examples 1 to 6 show the positive effect obtained with a reducing agent in the extraction of recalcitrant $^{137}Cs$ present in a sample of dusts already treated with the leaching method (according to the Italian Patent No. 1 358 799); these examples show the percentage of the extracted $^{137}Cs$ (in addition with respect to the sole leaching) as a function of the concentration of the reducing agent that was used.

Example 7 shows the positive effect obtained with an oxidising agent in the extraction of recalcitrant $^{137}Cs$ present in a sample of dusts already treated with the leaching method.

Example 8 compares the advantages obtained when directly using the reducing agent with respect to a prior extraction by leaching.

Examples 9 and 10 concern two additional and different ways of destabilisation by reduction.

Example 11 concerns the chemical-physical destabilisation by oxidation.

Method of Reduction or Oxidation in the Hydro-Metallurgical Field

The method for removing the $^{137}Cs$ from polluted EAF dusts according to a first embodiment, in the hydro-metallurgical field, of the present invention comprises the following steps:

i) providing an amount of EAF dusts polluted with $^{137}Cs$, having an initial average value also >10,000 Bq/kg;

ii) subjecting the dusts to a chemical-physical destabilisation reaction by reduction, also electrochemically, or by oxidation; and iii) following the chemical-physical destabilisation reaction by reduction, also electrochemically, or by oxidation, obtaining the release of cesium in a solution.

As aforesaid, the EAF dusts polluted with $^{137}Cs$ treatable with the method according to the present invention can have any value of initial radioactivity concentration, either higher or lower than 10,000 Bq/kg.

When the dusts to be treated have already undergone a leaching according to the Italian Patent No. 1 358 799, the pre-treated EAF dusts are added with a basifying agent, so as to maintain the same previous alkaline conditions, as well as with a reducing or oxidizing agent.

Preferably, the basifying agent is $NaHCO_3$, but other substances suitable for producing basic solutions can also be used.

Preferably the reducing agent is Dithionite, the use of which is known for extracting Fe from soils (under the different forms in which it is present) and for reducing chromates. The Dithionite is a sulphide containing oxyanions that, in an aqueous solution, quickly forms two sulphoxyl radicals according to the following reaction a):

$$S_2O_4^{2-} \leftrightarrow 2SO_2^{1-} \qquad a)$$

These radicals cause a reduction of iron (III), also present in the ferrites, from Fe(III) to Fe(II) according to the following reaction b):

$$(Fe^{3+})_{2n}+nS_2O_4^{2-} \leftrightarrow (Fe^{2+})_{2n}+2nSO_2 \qquad b)$$

allowing the release in a solution of the Cs ions that were captured at the surface of the ferrites.

Preferably the oxidizing agent is Potassium Permanganate, which acts in a weakly alkaline solution according to the reaction c):

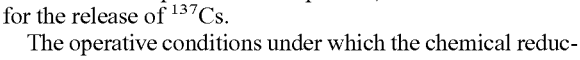

$$MnO_4^- + 4H^+ + 3e^- \leftrightarrow MnO_2 + 2H_2O \quad c)$$

or in a strongly alkaline solution according to the reaction d):

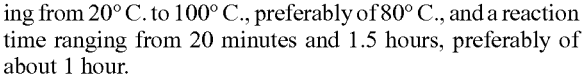

$$MnO_4^- + e^- \leftrightarrow MnO_4^{2-} \quad d)$$

Simultaneously, the $Fe^{2+}$ is oxidised to $Fe^{3+}$.

The oxidation reaction could involves also the oxidation of other chemical species that are present, but this is irrelevant for the release of $^{137}Cs$.

The operative conditions under which the chemical reduction or oxidation reactions take place are: a temperature ranging from 20° C. to 100° C., preferably of 80° C., and a reaction time ranging from 20 minutes and 1.5 hours, preferably of about 1 hour.

The higher the temperature, the faster the chemical destabilisation; the reaction time is then also affected by the possible stirring as well as by the dusts particle size (more limited times correspond to a fine particle size; longer times correspond to a coarse particle size).

The present embodiment of the invention will be now better described with reference to the examples 1 to 6 below that show the specific effect caused by the reducing agent with respect to the sole leaching treatment.

Said examples illustrate a first series of experimental tests in which the dusts samples used, initially treated according to the alkaline leaching with water, had a residual content of $^{137}Cs$ of about 500 Bq/kg, such as to be refractory to a further leaching.

These examples confirm what was previously stated, namely that the method according to the present invention allows to treat EAF dusts polluted with $^{137}Cs$ having any value of initial radioactivity concentration, either lower or higher than 10,000 Bq/kg, and even very low concentrations, of 500 Bq/kg, as shown below.

The reductive attack tests were performed on this sample to verify the possibility of carrying out the chemical destabilisation of the complex Cs-ferrites in order to implement the extractive yield.

$NaHCO_3$ was chosen as basifying agent and Dithionite was chosen as reducing agent.

Example 1

An amount of 75 g of polluted dusts already leached according to the Italian Patent No. 1 358 799, with a residual content of $^{137}Cs$ of about 500 Bq/kg, was suspended in 150 mL of water; then 0.4 g of $NaHCO_3$ and 0.2 g of Dithionite (0.27% by weight) were added.

The solution was maintained at a temperature of about 80° C. for 1 hour and then centrifuged.

The amount of $^{137}Cs$ passed in solution, which was found to be 20.9% of the total present in the polluted dust, was determined by radiometric analysis.

Example 2

The same amount of polluted dusts considered in Example 1 was added with an equal amount of $NaHCO_3$ and with 0.3 g of Dithionite (0.40% by weight).

Similarly to Example 1, the solution was maintained at a temperature of about 80° C. for 1 hour, and then centrifuged.

By the same technique used in Example 1 was therefore determined the amount of $^{137}Cs$ passed in solution, which was found to be 25.3%.

Example 3

The same amount of polluted dusts considered in Example 1 was added with an equal amount of $NaHCO_3$ and with 0.5 g of Dithionite (0.67% by weight).

Similarly to Example 1, the solution was maintained at a temperature of about 80° C. for 1 hour, and then centrifuged.

By the same technique used in Example 1 was therefore determined the amount of $^{137}Cs$ passed in solution, which was found to be 38.6%.

Example 4

The same amount of polluted dusts considered in Example 1 was added with an equal amount of $NaHCO_3$ and with 1.5 g of Dithionite (2% by weight).

Similarly to Example 1, the solution was maintained at a temperature of about 80° C. for 1 hour, and then centrifuged.

By the same technique used in Example 1 was therefore determined the amount of $^{137}Cs$ passed in solution, which was found to be 54.5%.

Example 5

The same amount of polluted dusts considered in Example 1 was added with an equal amount of $NaHCO_3$ and with 3 g of Dithionite (4% by weight).

Similarly to Example 1, the solution was maintained at a temperature of about 80° C. for 1 hour, and then centrifuged.

By the same technique used in Example 1 was therefore determined the amount of $^{137}Cs$ passed in solution, which was found to be 58.8%.

Example 6

The same amount of polluted dusts considered in Example 1 was added with an equal amount of $NaHCO_3$ and with 7.5 g of Dithionite (10% by weight).

Similarly to Example 1, the solution was maintained at a temperature of about 80° C. for 1 hour, and then centrifuged.

By the same technique used in Example 1 was therefore determined the amount of $^{137}Cs$ passed in solution, which was found to be 66.2%.

The results are summarised in the following table and graph:

| Example | % Dithionite | % $^{137}Cs$ extracted |
|---|---|---|
| 1 | 0.27 | 20.9 |
| 2 | 0.40 | 25.3 |
| 3 | 0.67 | 38.6 |
| 4 | 2.00 | 54.5 |
| 5 | 4.00 | 58.8 |
| 6 | 10.00 | 66.2 |

As it can be seen from the experimental tests carried out, by increasing the Dithionite concentration, a progressive increase of the extraction is obtained; however, it can be noticed that from a Dithionite content of 2% on, a significant slowdown of the extractive yield occurs.

These data have been interpreted in terms of release of the $^{137}Cs$ present in the most superficial part of the ferrites following the reductive destruction of the crystal lattice (by reduction from Fe(III) to Fe(II), as aforesaid).

It is therefore evident that the reduction performed by the Dithionite allowed a further decontamination of the starting material, i.e. of the polluted dusts pre-treated by alkaline leaching.

Example 7

In this example the same amount of polluted dusts considered in Example 1 was used, which was added with an equal amount of $NaHCO_3$ and with 1.8 g of $KMnO_4$ (2.4% by weight) in the form of a concentrated solution.

Similarly to Example 1, the solution was maintained at a temperature of about 80° C. for 1 hour, and then centrifuged; the final solution had a light violet colour.

By the same technique used in Example 1 was therefore determined the amount of $^{137}Cs$ passed in solution, which was found to be 41.3%.

It is therefore evident that also the oxidation (in this case made with $KMnO_4$) allowed a further decontamination of the starting material, i.e. of the polluted dusts already treated by alkaline leaching.

Comparative Example 8

This example compares the extraction yield of $^{137}Cs$, obtained by treating the same amount of EAF dusts, thoroughly homogenised, through the leaching with water (according to the Italian Patent No. 1 358 799), with the yield achieved through an extraction directly carried out with a solution containing Dithionite as reducing agent (2% by weight with respect to the mass of dust to be extracted).

In both cases the temperature of the solutions was the same (80° C.), the pH equal to 12, while the extraction time was 1 hour for both tests.

Two comparing tests of the yield were performed under the same conditions: the operations carried out with the solution containing the reducing agent led to extract an amount of $^{137}Cs$ significantly higher.

In the first test a percentage of 48% more than that obtained with the simple leaching was extracted, while in the second test a percentage of 51% more than that obtained with the simple leaching was extracted.

This example shows that it is not necessary to operate on dusts pre-treated by leaching, but decontamination can be done, directly and advantageously, with the solution containing the reducing agent.

The Inventors believe that, for achieving best results, more drastic conditions should occur, both in terms of concentration of the reducing agent and in terms of reaction time; this tightening of the operating conditions, however, appears to be of little advantage in terms of the process overall yield.

Since the destabilisation of the system Cs-ferrites by reduction or by oxidation gave encouraging results, for verification and control further tests were performed, which were focused on alternative approaches to the reduction or the oxidation of the dusts.

Method of Reduction in the Pyro-Metallurgical Field

The method for removing the $^{137}Cs$ from polluted EAF dusts according to a second embodiment, in the pyro-metallurgical field, of the present invention comprises the following steps:

i) providing an amount of EAF dusts polluted with $^{137}Cs$, having an initial average value also >10,000 Bq/kg;

ii) subjecting the dusts to a chemical-physical destabilisation reaction by reduction at high temperature; and iii) following the chemical-physical destabilisation reaction by reduction, obtaining the release of cesium.

As aforesaid, the EAF dusts polluted with $^{137}Cs$ treatable with the method according to the present invention can have any value of initial radioactivity concentration, either higher or lower than 10,000 Bq/kg.

Typical reducing agents are C, $H_2$ and $CH_4$; the reaction temperature is higher than 800° C., preferably of about 1,000° C.

The present embodiment of the invention will be now better described with reference to the examples 9 and 10 below, in which two "dry" systems were used; in particular in the example 9 carbon is used as reducing agent while in the example 10 $H_2$ is used.

Also these examples confirm what was previously stated, namely that the method according to the present invention allows to treat EAF dusts polluted with $^{137}Cs$ having any value of initial radioactivity concentration, either lower or higher than 10,000 Bq/kg, and even very low concentrations, of 500 Bq/kg, as shown below.

Example 9

An amount of 50 g of polluted EAF dusts (500 Bq/kg) was mixed with coal powder (5% by weight) and reacted according to the following reactions e) and f):

$$C+\tfrac{1}{2}O2=CO \qquad e)$$

$$Fe_3O_4+CO=3FeO+CO_2 \qquad f)$$

The reaction was carried out at about 1,000° C. and proceeded until the formation of Fe(0).

The reaction time was approximately 1 hour.

The result, in this case, was even more surprising; as a matter of facts, on the treated sample of EAF dusts, the almost total removal of the $^{137}Cs$ was observed ($^{137}Cs$ content present in the residue <0.5 Bq abs.), while the residue was consisting of Fe(0) and of Al and Si oxides.

The $^{137}Cs$ was extracted at the vapour state together with other volatile elements (Zn, Cd, etc.).

In the case of reduction with coal powder, also a microwave heating system has been successfully used.

Example 10

An amount of 50 g of polluted EAF dusts (500 Bq/kg) was subjected to direct reduction in a $H_2$ atmosphere according to the following reaction g):

$$Fe_3O_4+H_2=3FeO+H_2O \qquad g)$$

The reaction was carried out at about 1,000° C.

The reaction time was approximately 1 hour.

Also in this case the result was surprising; as a matter of facts, upon exit from the furnace, the almost total removal of the $^{137}Cs$ from the EAF dusts was observed ($^{137}Cs$ content present in the residue <0.5 Bq abs.), while the residue was consisting of Fe(0) and of Al and Si oxides.

The $^{137}Cs$ was extracted at the vapour state together with other volatile elements (Zn, Cd, etc.).

The use of methane as reducing agent in the present embodiment of the invention is not illustrated here by means of a specific example; however, it is based on the following reaction h):

$$CH_4+H_2O=3H_2+CO \qquad h)$$

The tests of chemical-physical destabilisation by reduction gave excellent results, since a decontamination between 98% and 100% from the $^{137}Cs$ initially present in the dusts was achieved.

Since the release of cesium at high temperature has occurred by reductive destabilisation of the system as shown by the examples 9 and 10, the Inventors have deemed that, by analogy, also the oxidative destabilisation could be effective to release the $^{137}Cs$.

Therefore, as a proof, further tests were performed focused on oxidation systems of the dusts.

Method of Oxidation in the Pyro-Metallurgical Field

The method for removing the $^{137}Cs$ from polluted EAF dusts according to a third embodiment, in the pyro-metallurgical field, of the present invention comprises the following steps:

i) providing an amount of EAF dusts polluted with $^{137}Cs$, having an initial average value also >10,000 Bq/kg;

ii) subjecting the dusts to a chemical-physical destabilisation reaction by oxidation at high temperature; and iii) following the chemical-physical destabilisation reaction by oxidation, obtaining the release of cesium.

As aforesaid, the EAF dusts polluted with $^{137}Cs$ treatable with the method according to the present invention can have any value of initial radioactivity concentration, either higher or lower than 10,000 Bq/kg.

Typical oxidising agents are $O_2$, air and oxygen-enriched air; the reaction temperature is higher than 800° C., preferably of about 1,000° C.

The present embodiment of the invention will be now better described with reference to the example 11 below.

Also this example confirms what was previously stated, namely that the method according to the present invention allows to treat EAF dusts polluted with $^{137}Cs$ having any value of initial radioactivity concentration, either lower or higher than 10,000 Bq/kg, and even very low concentrations, of 500 Bq/kg, as shown below.

Example 11

An amount of 50 g of polluted EAF dusts (500 Bq/kg) was subjected to oxidation using, as oxidising agent, oxygen from the air according to the following reaction k):

$$2Fe_3O_4+O_2=3Fe_2O_3 \qquad k)$$

The reaction was carried out at about 1,000° C.

The reaction time was approximately 1 hour.

In this case the destabilisation of the system Cs-ferrites at high temperature led to the formation of volatile oxides, among which the cesium oxide, and to the formation of a residue consisting of $Fe_2O_3$, oxides of some metals and oxides of Al, Si and Ca, with a $^{137}Cs$ content present in the residue <0.5 Bq abs.

Also the tests of chemical-physical destabilisation by oxidation gave excellent results, since a decontamination between 98% and 100% from the $^{137}Cs$ initially present in the dusts was achieved.

In conclusion, the Inventors believe that the experimental tests described above demonstrate that the chemical-physical destabilisation, both reductive and oxidative, of EAF dusts polluted with $^{137}Cs$ is the key for releasing and recovering the radioactive contaminant.

In the hydro-metallurgical field the reaction carried out under mild reducing conditions primarily affects the most superficial layers of the materials that have captured the cesium and allows a reduction of over 60% of the $^{137}Cs$ recalcitrant to leaching alkaline.

It is to be underlined, however, that a preliminary alkaline leaching is clearly neither useful nor necessary, since it is possible to operate directly on the dusts with a reducing solution as demonstrated by the comparative example 8.

Moreover, at present, the oxidative hydro-metallurgical treatment appears to be less favourable than the reductive one.

The higher yields in terms of decontamination were obtained with both the pyro-metallurgical methods, where the almost complete separation of said $^{137}Cs$ from said dusts is obtained.

It may be noted here that, although these experimental tests have been carried out on certain amounts of EAF dusts having certain contamination levels, the method according to the present invention can be extrapolated to different amounts with different radioactive contamination levels, either higher or lower than 10,000 Bq/kg, on the basis of the reactions reported in the present description.

It is also useful to observe that the choice of the optimal method for removing $^{137}Cs$ from polluted EAF dusts among the different embodiments described above, with reductive and/or oxidative destabilisation (in the hydro- or pyro-metallurgical field) mostly depends on the initial concentration and contamination characteristics of the EAF dust to be treated as well as on the desired final activity (e.g., <380 Bq/kg or <1,000 Bq/kg or <10,000 Bq/kg).

By way of example it is reported that, starting from a sample of EAF dusts having an initial contamination value of 218,500 Bq/kg:

with the treatment of alkaline leaching with water, a radioactivity reduction to a value of 18,680 Bq/kg was obtained;

directly operating with the reductive destabilisation with Dithionite, a radioactivity reduction to a value of 9,285 Bq/kg was obtained; and with the additional oxidative destabilisation (according to Example 11), a radioactivity reduction to a value <380 Bq/kg with an overall yield close to 100% was obtained.

With the above example what was previously stated is intended to be confirmed, namely that the method according to the present invention allows to treat EAF dusts polluted with $^{137}Cs$ having any value of initial radioactivity concentration, either lower or higher than 10,000 Bq/kg, and even at very high concentrations, even >200,000 Bq/kg as now shown.

The reduction and/or oxidation reactions can be carried out in traditional plants; the application of these reactions in the method according to the present invention, however, requires specific adjustments.

As a matter of facts, the presence of radioactive material involves a number of precautions in terms of safety (specifically: equipment shielding, containment vessels, filters and control systems), which would make it impossible to use "tout court" the conventional plants.

Furthermore the recovery of the "off-gases" has, in this case, all the peculiar problems due to the presence of the radioactive material.

More precisely, a plant for carrying out the method according to the embodiment in the hydro-metallurgical field of the present invention comprises:

a reactor for carrying out the chemical-physical destabilisation reaction of the EAF dusts polluted with $^{137}Cs$;

a separation and recovery system of the $^{137}Cs$ from the extraction solution of the EAF dusts; and a recovery system of the decontaminated EAF dusts.

For clarity's sake, it is emphasised that said plant is characterised by implementing the method for removing the $^{137}Cs$ from polluted EAF dusts through a chemical-physical destabilisation reaction in the hydro-metallurgical field by reduction or oxidation.

A plant for carrying out the method according to the embodiment in the pyro-metallurgical field of the present invention comprises:

- a furnace for carrying out the reductive or oxidative chemical-physical destabilisation reaction of the EAF dusts polluted with $^{137}Cs$;
- a separation and recovery system of the $^{137}Cs$ extracted from the EAF dusts; and
- a recovery system of the decontaminated EAF dusts.

For clarity's sake, it is emphasised that said plant is characterised by implementing the method for removing the $^{137}Cs$ from polluted EAF dusts through a chemical-physical destabilisation reaction in the pyro-metallurgical field by reduction or oxidation.

In the pyro-metallurgical field, the system can be directly fed with the polluted EAF dusts, as described above, but also, in case, with residual dusts coming from a hydro-metallurgical treatment.

A plant for carrying out the method according to the embodiment by reductive destabilisation in the pyro-metallurgical field of the present invention for removing the $^{137}Cs$ contained in polluted EAF dusts, having an average value also >10,000 Bq/kg (but also, in case, with residual dusts coming from a hydro-metallurgical treatment) comprises:

- a furnace where the dusts mixed with the coal powder (5% by weight) or in a $H_2$ atmosphere are heated;
- a gas removal system provided with a collection device for both the Cs and the other volatile elements; and
- a separation system of the Cs from the gas removal aqueous solution;
- a collection system of the decontaminated reduced dusts with a removal of the activity concentration of the $^{137}Cs$ between 98% and 100%.

Similarly to what was previously described as to the method according to the present invention, the EAF dusts polluted with $^{137}Cs$ treatable with the aforesaid plant can have any value of initial radioactivity concentration, either higher or lower than 10,000 Bq/kg.

Moreover, a plant for carrying out the method according to the embodiment by oxidative destabilisation in the pyro-metallurgical field of the present invention for removing the $^{137}Cs$ contained in polluted EAF dusts, having an average value also >10,000 Bq/kg (but also, in case, with residual dusts coming from a hydro-metallurgical treatment) comprises:

- a reactor where the dusts in an oxygen atmosphere or in air are heated;
- a gas removal system provided with a collection device for the volatile oxides, Cs included;
- a separation system of the Cs from the gas removal aqueous solution;
- a collection system of the decontaminated oxidised dusts with a removal of the activity concentration of the $^{137}Cs$ between 98% and 100%.

As aforesaid, the EAF dusts polluted with $^{137}Cs$ treatable with the aforesaid plant can have any value of initial radioactivity concentration, either higher or lower than 10,000 Bq/kg.

In order to obtain EAF dusts decontaminated from $^{137}Cs$, the use of the destabilisation reactions takes place according to specific conditions.

In particular, the use of the destabilisation reactions according to the present invention provides conditions such as to allow the reduction below 380 Bq/kg of the $^{137}Cs$ content from EAF dusts contaminated also with an average value also >10,000 Bq/kg.

These conditions affect the reducing or oxidising agents used, as well as the temperatures and the reaction times as resulting from the experimental tests mentioned above.

While the invention here presented has been illustrated, described and defined with reference to particular preferred embodiments, these references and embodiments given in the above description do not imply any limitation of the invention.

It is, however, evident that various modifications and variations can be made without departing from the broader protective scope of the illustrated technical concept.

Thus, for example, the Inventors believe that also the electrochemical reduction of the iron oxides, in an alkaline medium, falls within the wider field of the reduction reactions.

The illustrated preferred embodiments are merely exemplary and they are not exhaustive of the protective scope of the technical concept here presented.

Therefore, the protective scope is not limited to the preferred embodiments described in the detailed description, but is limited only by the claims that follow.

The invention claimed is:

1. A method for removing the $^{137}Cs$ from polluted EAF dusts, comprising the steps of:

i) providing an amount of EAF dusts polluted with $^{137}Cs$;

ii) subjecting the dusts to a chemical-physical destabilisation reaction by oxidation or reduction; and iii) after the chemical-physical destabilisation reaction by oxidation or reduction, the release of cesium is obtained.

2. A method according to claim 1, wherein said EAF dusts polluted with $^{137}Cs$ have an initial average value also >10,000 Bq/kg and wherein the removal of $^{137}Cs$ has a yield of 98%-100%.

3. A method according to claim 1, wherein the chemical-physical destabilisation takes place in the hydro-metallurgical field by reduction using a reducing agent or an electrochemical reaction or through an oxidation reaction using an oxidizing agent.

4. A method according to claim 3, wherein the reducing agent is Dithionite and the oxidizing agent is $KMnO_4$.

5. A method according to claim 3, wherein the reduction or oxidation reactions take place at a temperature >20° C., preferably at 80-90° C., and at a reaction time between 20 minutes and 1.5 hours, preferably at about 1 hour.

6. A method according to claim 1, wherein the chemical-physical destabilisation takes place in the pyro-metallurgical field through a reduction reaction.

7. A method according to claim 6, wherein the EAF dusts are mixed with coal powder or subjected to direct reduction in $H_2$ or $CH_4$ atmosphere.

8. A method according to claim 1, wherein the destabilisation takes place in the pyro-metallurgical field through an oxidation reaction.

9. A method according to claim 8, wherein the oxidation reaction takes place by using, as an oxidizing agent, pure oxygen or oxygen from the air or oxygen-enriched air.

10. A method according to claim 6, wherein the reaction takes place at a temperature >800° C.

11. A method according to claim 10, wherein the heating is produced by microwaves.

12. A hydro-metallurgical plant for removing $^{137}Cs$ from polluted EAF dusts, comprising:

- a reactor for carrying out the reductive or oxidative chemical-physical destabilisation reaction;
- a separation and recovery system of the $^{137}Cs$ from the extraction solution of the EAF dusts; and
- a recovery system of the decontaminated EAF dusts, wherein it carries out the method according to claim 1.

13. A pyro-metallurgical plant for removing $^{137}Cs$ from polluted EAF dusts, comprising:

a furnace for carrying out the reductive or oxidative chemical-physical destabilisation reaction of the EAF dusts polluted with $^{137}Cs$;

a separation and recovery system of the $^{137}Cs$ extracted from the EAF dusts, and a recovery system of the decontaminated EAF dusts wherein it carries out the method according to claim 1.

14. A plant according to claim 12, wherein said EAF dusts polluted with $^{137}Cs$ have an initial average value also >10,000 Bq/kg.

15. A method for removing $^{137}Cs$ from polluted EAF dusts, with an initial average value also >10,000 Bq/kg, in order to obtain a decontamination yield of 98%-100% from the $^{137}Cs$ initially present in the EAF dusts which comprises contacting EAF dusts in a plant as defined in claim 12 with an oxidizing agent or a reducing agent.

16. A method according to claim 8, wherein the reaction takes place at a temperature >800° C.

17. A method for removing $^{137}Cs$ from polluted EAF dusts, with an initial average value also >10,000 Bq/kg, in order to obtain a decontamination yield of 98%-100% from the $^{137}Cs$ initially present in the EAF dusts which comprises contacting EAF dusts in a plant as defined in claim 13 with an oxidizing agent or a reducing agent.

* * * * *